US006708448B2

(12) United States Patent
Zappa

(10) Patent No.: US 6,708,448 B2
(45) Date of Patent: Mar. 23, 2004

(54) DRIVE UNIT FOR DOORS, ESPECIALLY ELEVATOR DOORS HAVING A NON-RECTILINEAR PROFILE

(75) Inventor: Roberto Zappa, Bergamo (IT)

(73) Assignee: Sematic Italia S.p.A., Bergamo (IT)

( * ) Notice: Subject to any disclaimer, the term of this patent is extended or adjusted under 35 U.S.C. 154(b) by 0 days.

(21) Appl. No.: 09/849,887

(22) Filed: May 4, 2001

(65) Prior Publication Data

US 2001/0037601 A1 Nov. 8, 2001

(30) Foreign Application Priority Data

May 8, 2000 (IT) ..... MI2000A1000

(51) Int. Cl.[7] ..... E06B 3/34
(52) U.S. Cl. ..... 49/41; 49/362; 49/118
(58) Field of Search ..... 49/40, 116, 118, 49/360, 41, 362

(56) References Cited

U.S. PATENT DOCUMENTS 1,525,338 A * 2/1925 Thackston ..... 49/118
1,634,954 A * 7/1927 McInerney ..... 49/118
4,785,579 A * 11/1988 Sugiyama et al. ..... 49/40
4,991,347 A * 2/1991 Takimoto et al. ..... 49/40
5,353,457 A * 10/1994 Chu ..... 5/640
5,483,769 A * 1/1996 Zweili ..... 49/118
5,987,817 A * 11/1999 Hein ..... 49/40

FOREIGN PATENT DOCUMENTS

JP 62-187078 * 11/1962 ..... 49/40
JP 403151484 * 6/1991 ..... 49/40

* cited by examiner

*Primary Examiner*—Jerry Redman
(74) *Attorney, Agent, or Firm*—Abelman, Frayne & Schwab

(57) ABSTRACT

A drive unit for doors, especially doors having a non-rectilinear profile formed by wings (26, 26', 24, 24', 124, 126) comprises a motor (10) whose rotary shaft (20) engages with at least a bar or section (12, 14) connected to at least one of said wings. The drive unit is located either on the roof or the external front of the lower basis or between the wings of an elevator car of story doors. In case of telescopic movement superposed wings, one of the wing is moved by the drive unit, and a transmission unit (100) transmits the rotation of a wing (124) to the other one (126).

17 Claims, 4 Drawing Sheets

DRIVE UNIT FOR DOORS, ESPECIALLY ELEVATOR DOORS HAVING A NON-RECTILINEAR PROFILE

BACKGROUND OF THE INVENTION

1. Field of the Invention

The present invention relates to a drive unit for doors, especially doors having a non-rectilinear profile.

More particularly, the present invention relates to a drive unit for elevator doors having a semicircular profile.

2. Description of Related Art

As is known, elevator systems comprise cars of various type, mainly of parallelepiped form with a square or quadrangular plan. In these cases, the doors that close the car room slide rectilinearly along special guides.

Circular plan cars are also common in civil and commercial buildings, and are utilized both for elevators and to create access zones to buildings such as, for instance, banks, hotels and public facilities.

Obviously, the doors of these cars have a profile that is not rectilinear but semicircular or, more precisely, circle-arch shaped. The cars of this type have severe drawbacks as concerns the opening and closing movements of the related doors. In fact, the motor units must comprise connections able to transform the rectilinear motion into a motion developed along circle-arches parallel to the profile of the car.

The traditional solutions adopted to this aim are extremely complicated from both the construction and the functional aspects, because of the presence of a high number of components, such as, for instance, articulated arms, tie-rods and transmissions.

As a consequence, also maintenance and repair operations of the apparatus intended for door movement are exacting, difficult and sometimes critical.

A further drawback which is found in circular plan cars is associated to the big size and weight of the drive unit of the door, independently on whether it is located on the roof or the base of the car.

There are, in fact, necessary specific reinforcement and supporting structures that concur to further complicate the construction and the assembly of the system.

The presence of many linkages and transmissions gives also rise to a high friction between the moving parts, requiring the use of high power motive units, with an ensuing increase in energy consumption.

BRIEF SUMMARY OF THE INVENTION

Object of the present invention is to obviate the above drawbacks.

More particularly, object of the present invention is to provide a drive unit for doors having a non rectilinear profile, in particular and especially elevator doors with a circular plan such as not to require the use of many elements interconnected with each other to cause such movement.

A further object of the invention is to provide a drive unit as defined above, extremely compact, of a limited weight and suitable to be connected in a quick and easy manner to the roof or the base of the car.

A further object of the present invention is to provide a movement group that does not involve maintenance interventions.

A further object of the invention is to provide a drive unit wherein the friction between the components is extremely reduced.

A further object of the invention is to provide a drive unit for doors having a rectilinear profile, suitable to ensure a high level of resistance and reliability in the time, and also such as to be easily and economically realized.

These and still other objects are achieved by the drive unit for doors having a non-rectilinear profile, in particular for doors of circular plan elevator cars, constituted of aligned or telescopically moving superposed wings, characterized basically in that it comprises a motor provided with a shaft that rotates in alternate clockwise and anti-clockwise direction, and at least a bar or section connected to at least one of the wings and that engages with said shaft.

Said drive unit may be located on the roof or the lower base or between the wings of the elevator cars of story doors.

In the case of doors constituted of telescopic movement superposed wings, the bar or section is connected to one only of the wings, and a transmission unit transmits the rotation of said wing to the other wing of the door.

BRIEF DESCRIPTION OF THE SEVERAL VIEWS OF THE DRAWINGS

The constructive and functional characteristic of the drive unit for doors having a non rectilinear profile of the present invention will be better understood thanks to the following description wherein reference is made to the attached drawings which represent some preferred embodiments by way of non limiting examples and wherein.

In the description which follows the expression "bars", "sections" and "racks" are interchangeable with each other, and the words "pulley", "serrated pulley", "toothed pinion gear" and "serrated pinion gear" are also interchangeable with each other.

DETAILED DESCRIPTION OF THE INVENTION

Figure 1:
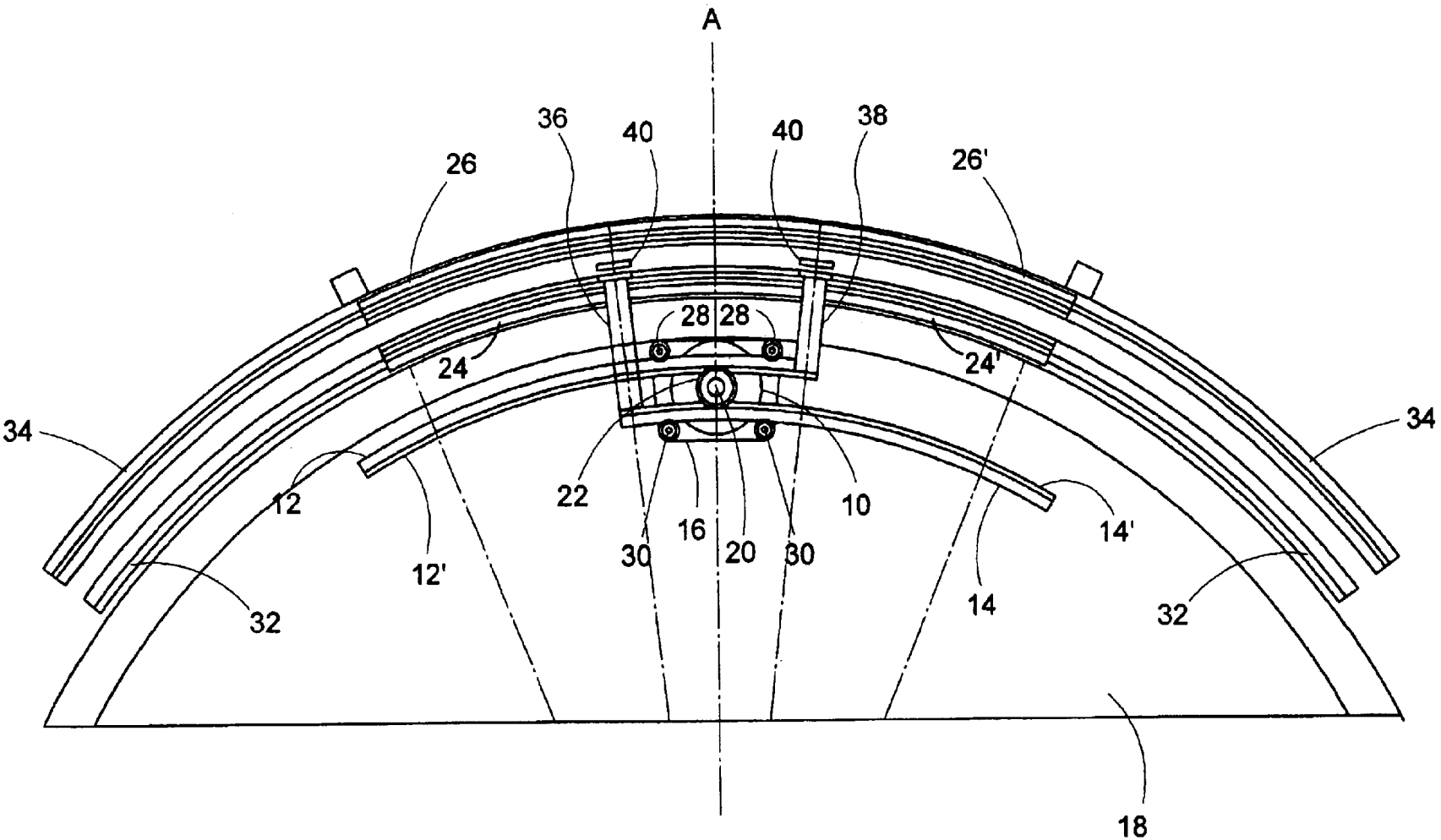
FIG. 1 shows the schematic top view of a part of a circular plan car in closing position and with the door wings aligned, provided with the unit of the present invention.
Figure 2:
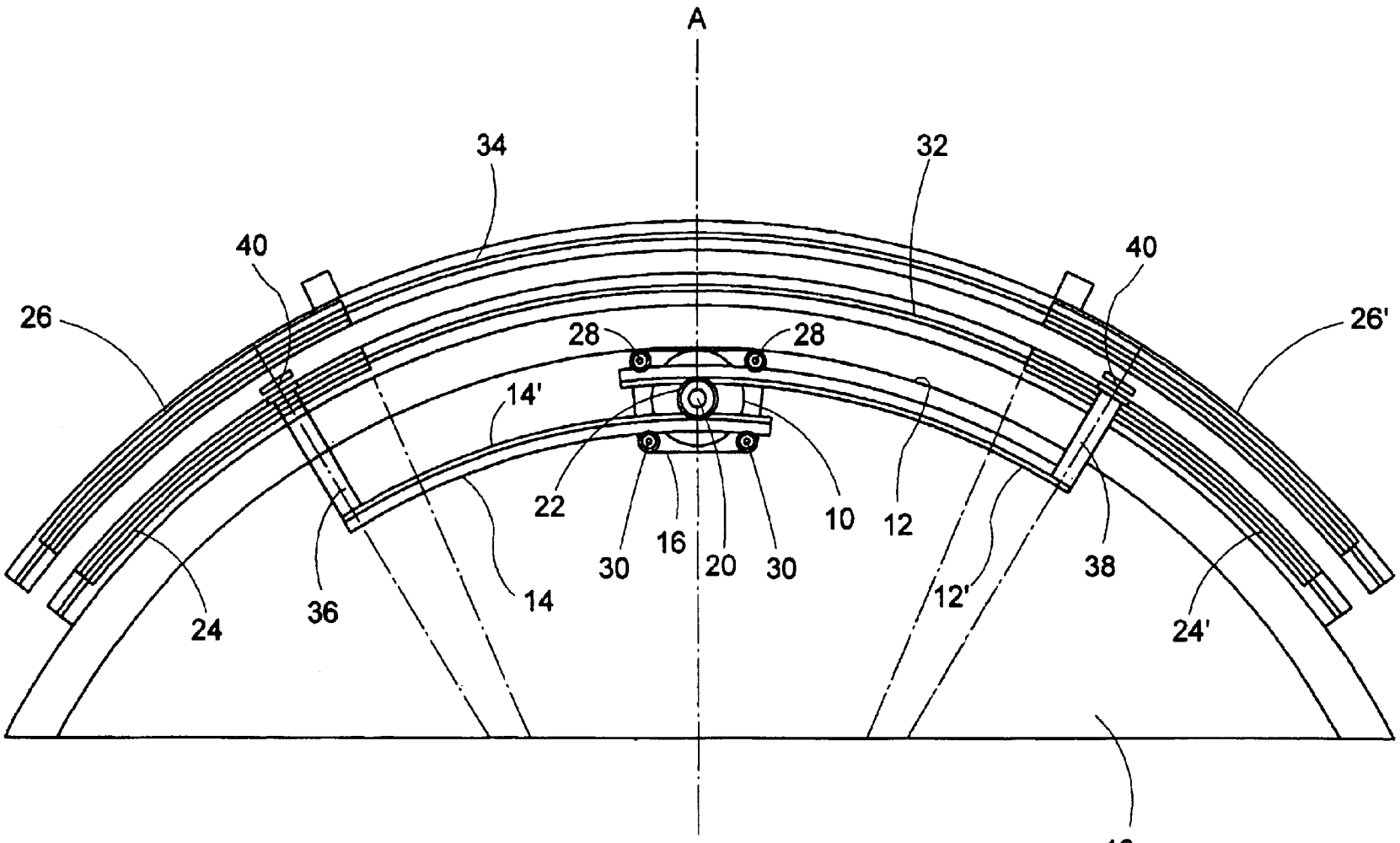
FIG. 2 shows the schematic top view of the same part of car of FIG. 1, in opening position.

FIGS. 1 and 2 show by way of example a car solution with automatic central opening aligned doors, both as concerns the internal or car wings, indicated by 24, 24', and as concerns the external or story ones, indicated by 26, 26'.

With reference to said FIGS. 1 and 2, the drive unit for doors having a non rectilinear profiles of the present invention basically comprises a motor 10, provided with a rotation shaft 20, and a couple of curved bars or sections. i.e., racks, 12,14, developed in the shape of a circle-arch, located on the opposite sides of said shaft 20. Motor 10 may advantageously be an asynchronous or synchronous electric motor or of another known type and may be supported by a conventional plate-like support 16 integral with roof 18 of the elevator car. Shaft 20 of motor 10 protrudes with an orientation that is preferably orthogonal with respect to the surface formed by roof 18.

Said shaft 20 might also be parallel to roof 18. A preferably serrated pulley 22, i.e., toothed or serrated pinion gear 22, is fixed to shaft 20. Bars or sections 12, 14 are curved according to a predetermined radius that corresponds to a circumference concentric with the circular profile of the elevator car. In particular, said sections 12, 14 develop in such a manner as to be substantially parallel on each point to the internal wings 24, 24' and external wings 26, 26' that form the car doors. Motor 10, through the related support 16, is advantageously fixed to roof 18 of the elevator car in a position close to said internal wings 24,24' and external wings 26,26', so that its shaft 20 is aligned with one of the car axes, i.e. along vertical A that corresponds substantially to the approach line of the internal wings 24, 24' and of the external wings 26, 26', in closing condition. Bars or sealons 12, 14 systematically strike diametrically opposed points of pulley 22, being respectively positioned, with respect to said wings 24,24',26,26', before or behind said pulley 22, and preferably on different plans or levels.

Pulley 22 strikes and engages with sections 12, 14, starting from their inner sides, that are facing and opposing each other. The external sides of said sections 12, 14 strike, on the contrary, guide means that may be two or more idle wheels or rollers 28, 30, protruding from the plate-like support 16 of motor 10. According to a preferred embodiment, the internal side of sections 12, 14 that strike pulley 22 are provided with indentations 12', 14', complementary to that of pulley 22. The latter ensures the constant engagement between the components during the movement, and the absence of possible slippings that would lead to asynchronies in the control of wings 24, 24', 26, 26' when the latter are opening or closing. Indentation 12', 14' on sections 12, 14 can be obtained by treating mechanically said sections or formed on an added element, obtained for instance from rubber or plastic material. On the other hand, it is not excluded the possibility that the engagement between pulley 22 and sections 12, 14 realizes also in the absence of indentations, as said components, or for instance only the pulley, can be periodically provided with a surface finishing or a rough covering or in any case a covering suitable to create a mechanical interference. A rubber covering on the sides of sections 12, 14 and/or the lateral surface of pulley 22 may be the proper solution for this purpose.

Motor 10, whose shaft 20 rotates alternatively in clockwise or anti-clockwise direction, causes the sliding of sections 12, 14 along circle-arches parallel to the circular profile of wings 24, 24' and 26, 26'.

Wings 24, 24' and 26, 26' slide in opening and closing orientation along conventional sliding sills or tracks, one of which 32 is internal for the internal wings 24, 24', and one external for the external wings 26, 26'. Wings 24, 24' and 26, 26' are connected with the respective sections 12, 14 by means of arms or tie-rods 36, 38.

In particular, each tie-rod 36, 38 is connected through known means to the external end of each section 12, 14. Tie-rods 36, 38 develop in the direction of said wings 24, 24', 26, 26' according to a substantially orthogonal orientation, striking them in a position close to the respective edges that approach to each other during the closing step. In case of an elevator provided with simultaneously moved car wings 24, 24' and story cars 26, 26', as shown in FIGS. 1 and 2, arms or tie-rods 36, 38 strike the first and innermost car wings 24, 24' and extends to reach the second and outermost story wing 26, 26. The connection between said tie-rods 36, 38 and wings 24, 24', 26, 26' is obtained through washers 40 or like connection means.

During the running stage, the drive unit of the present invention determines the alternated sliding in opposite directions of sections 12, 14, following the activation of motor 10 whose pulley 22 is engaged along the internal side of said sections. During the alternate sliding, said sections 12, 14 that are connected through tie-rod 36, 38 to wings 24, 24' and 26, 26', move said wings causing their moving away from, or approaching to, each other, sliding along guides 32, 34. Sections 12, 14, in their turn, are guided and kept in position by the idle wheels or rollers 28, 30, protruding from support 16 of motor 10.

Figure 3:
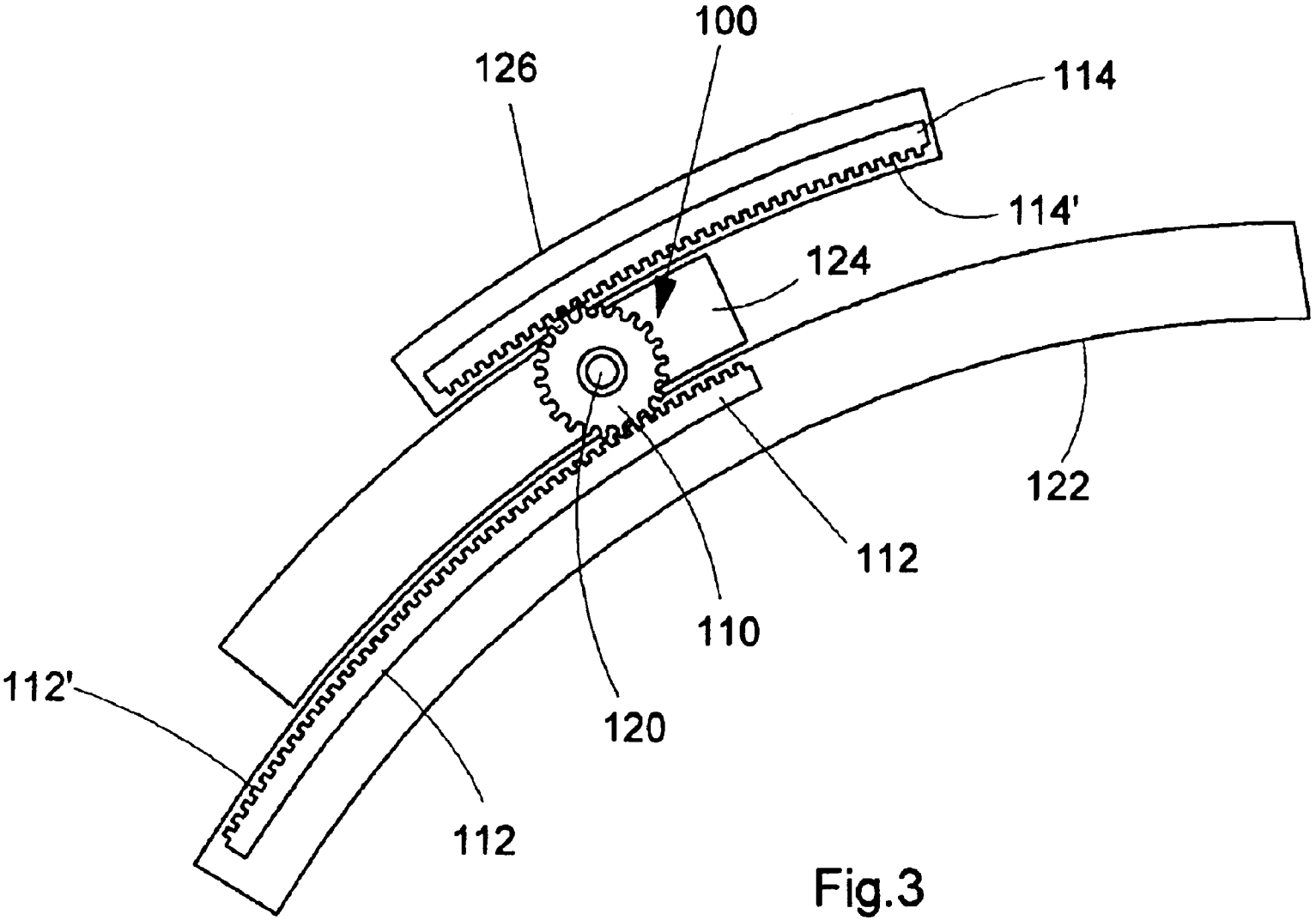
FIG. 3 shows the schematic top view of a circular plan car with superposed or telescopic wings, provided with a transmission group, also an object of the present invention.

FIG. 3 shows, by way of non limiting example, the application of the feeding unit of the present invention to an elevator having a semicircular profile with superposed wings that have a telescopic movement with respect to each other, with an automatic lateral opening of the internal 124 and the external 126 wings of a part of the elevator door.

FIG. 3 shows only a part of the elevator formed by two wings 124, 126 superposed according to a telescopic movement. The door comprises also two other wings, symmetrical with respect to each other, not shown in the figure.

The drive unit of the present invention provides to moving the internal wings 124, as described above. Said internal wings 124, in fact, are connected to the related sections 12, 14 through arms or tie-rods 36, 38. Sections 36,38 are moved by motor 10 through pulley 22 that engages along the internal side of the same, as described above in detail.

For the telescopic movement of internal 124 and external wing 126, a transmission unit 100 is provided, which is also object of the present invention.

With reference to FIG. 3, the transmission unit 100 comprises a second serrated idle pulley 110, pivoted on a shaft 120, and a couple of curved bars or sections 112, 114, located on the two opposite sides of said idle pulley 110.

Shaft 120 is fixed to the internal wing 124, in correspondence of its front end with respect to the opening of the elevator doors. Bars or sections 112, 114 are curved according to a circumference concentric with the circular profile of the elevator car. In particular, said sections or bars 112, 114 are substantially parallel both to wings 124, 126, and the fixed part of the car or structure 122 of story doors.

Bars or sections 112, 114 are fixed respectively to the fixed structure 122 and the external wing 126, and are so arranged as to strike the idle pulley 110 on opposite sides.

In order to ensure the constant engagement between the idle pulley 110 and the bars or sections 112, 114 during the movement, and to prevent a possible sliding, the internal sides of sections 112, 114, which strike pulley 110, are preferably provided with a complementary indentation 112', 114' that engages with the one of the idle pulley 110.

Identifications 112',114' may be obtained with mechanical operations directly on sections 112,114, or they may be obtained on a separate element, for instance from rubber or plastic material, and fixed to said sections 112, 114. Alternatively, there may be used any means able to ensure the dragging of bars or sections 112, 114 by the idle pulley 110, without sliding.

Thanks to the movement of the internal wing 124, caused by motor 10, pulley 110 rotates alternatively in clockwise and anti-clockwise direction, engaging with indentation 112' of section 112, fixed to the fixed structure 122. During the rotation, pulley 110 engages with indentation 114' of section 114', fixed to the external wing 126 and causes the simultaneous sliding of the external wing 126 with respect to the internal one 124. In particular, if the internal wing 124 slides at a velocity (V1) caused by the angular velocity of pulley 22 of motor 10, the external wing 126 slides at twice said velocity (V2=2V1).

In the running stage, the alternate closing and opening movement of the internal wing 124, caused by motor 10, causes the rotation of the idle pulley 110 that engages with section 112 fixed on the fixed structure 122. The rotation of pulley 110 induces a simultaneous alternate closing and opening movement of the external wing 126, in the same direction as the movement of the internal wings 124, to engage pulley 110 on section 114 fixed to the external wing 126.

As can be inferred from the above, the advantages achieved by the invention are evident.

The drive unit for doors having a non rectilinear profile of the present invention has an extremely simple structure formed by a low number of components directly connected to each other. The size and weight of the drive unit are very reduced and, in the absence of joints and transmissions, the assembly of the whole is simple and immediate. Given this advantageous structure, no particular and regular maintenance intervention are needed. Besides, the friction is substantially limited and therefore low power motors with reduced energy consumption may be utilized. While the present invention has been described above with reference to some embodiments thereof reported by way of non limiting example, many modifications and variants may be introduced by those skilled in the art, in the light of the above description.

For instance, the drive unit may be utilized for elevators provided only with automatic movement internal wings or one only lateral opening wing; in the latter case, there will be utilized only two rollers 28 or 30, associated with pulley 22 and a section 14 or 14'.

The drive unit of the present invention may also be connected to the lower base of the elevator car instead of the roof.

Motor 10, which in the figures is shown in a position orthogonal to the roof of car 18, may be positioned parallel to said car roof 18.

Besides, while being especially suited for the application to elevator doors or entry doors having a non rectilinear profile, the drive unit of the present invention may be utilized for traditional rectilinear profile doors, in which case sections 12 and/or 14 having a linear development will be used.

Figure 4:
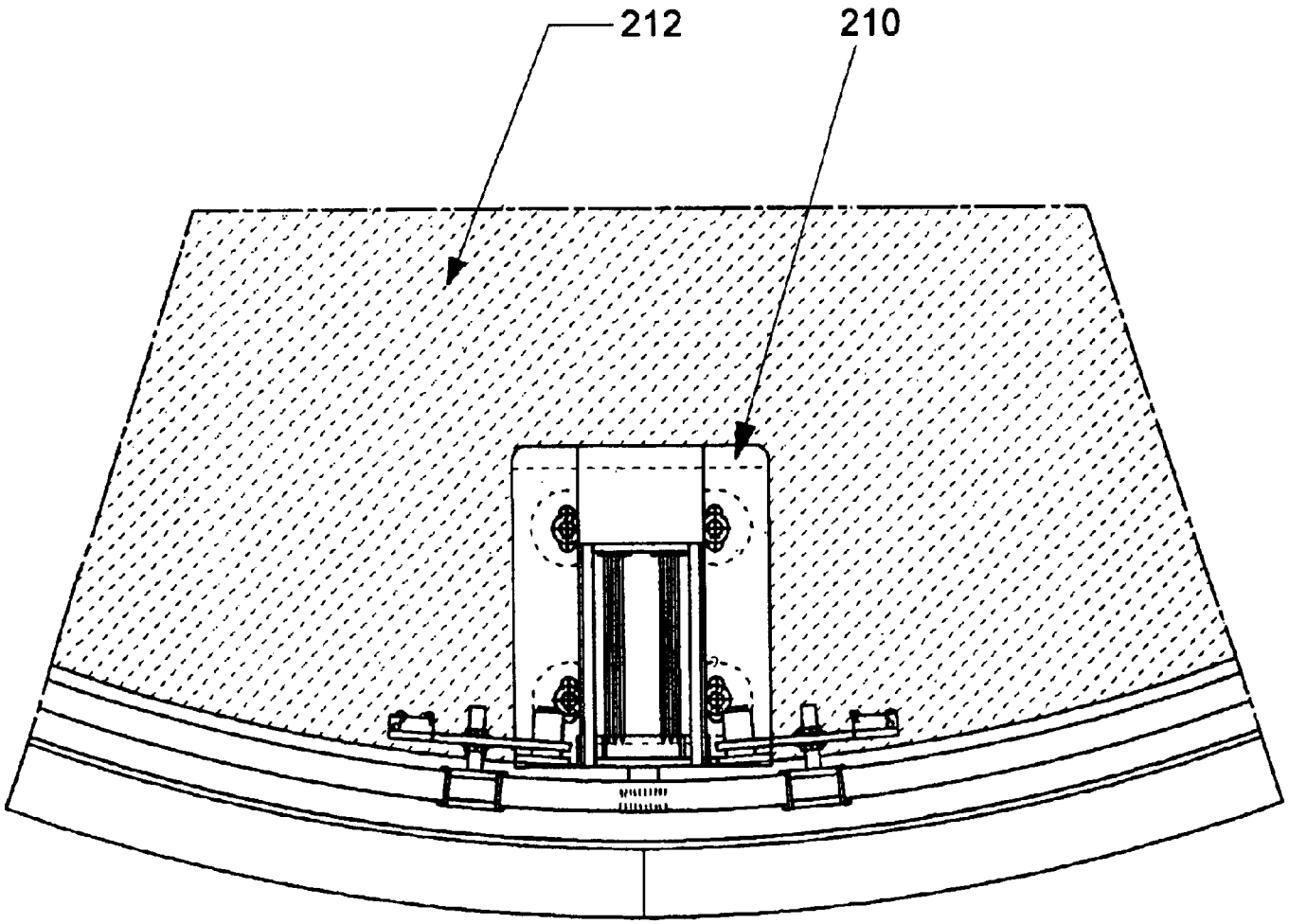
FIG. 4 shows the schematic top view of a circular plan car with superposed or telescopic wings, provided with a transmission group, and positioned on the cabin roof of an elevator.

Referring to FIG. 4, motor 210 constructed in accordance with the invention is shown on the cabin roof 212 of an elevator.

The present invention intends to comprise all the modifications and variants that fall within the protection scope of the following claims.

What is claimed is:

1. A drive unit for elevator doors of an elevator car having a non-rectilinear profile, formed by aligned (24, 24', 26, 26') wings, said unit comprising:

a motor (10) provided with a shaft (20, 120) that rotates in alternate clockwise and anti-clockwise directions;

at least a rack (12,14) connected to at least one of the wings (24, 24', 26, 26', 124, 126) which engages said shaft (20); and a gear provided with said shaft (20) of the motor (10) that engages with two racks (12, 14) located on opposite sides of said gear (22);

wherein said racks (12,14) are circle-arch curved according to a radius corresponding to a circumference concentric with a circular profile of the elevator car.

2. The drive unit according to claim 1, wherein said:

a gear (22) is serrated and strikes a corresponding indentation (12' 14') formed on inner sides, facing and opposite to each other, of said racks (12, 14).

3. The drive unit according to claim 2, wherein said motor (10) is supported by a plate (16) provided with guide and sliding means (28,30) for said racks (12,14).

4. The drive unit according to claim 2, wherein said wings (24,26,24',26') are respectively connected to said racks (12, 14) by means of arms (36,38).

5. The drive unit according to claim 1, wherein said motor (10) is supported by a plate (16) provided with guide and sliding means (28, 30) for said racks (12, 14).

6. The drive unit according to claim 5, wherein said wings (24,26,24',26') are respectively connected to said racks (12, 14) by means of arms (36,38).

7. The drive unit according to claim 1, wherein said wings (24, 26, 24',26') are respectively connected to said racks (12,14) by means of arms (36,38).

8. The drive unit according to claim 7, wherein said arms (36, 38) are connected to said wings (26, 26' 24, 24') by means of washers (40).

9. The drive unit according to claim 1, wherein said racks (12,34) are located on different levels and strike points diametrically opposed to said pinion (22).

10. The drive unit according to claim 1, wherein the drive unit is located on a roof (18) of the elevator car, on an external front of the lower basis of the elevator car, in a position close to said wings (24, 24', 26, 26') and in such a way that said shaft (20) of said motor (10) is substantially on a line with an approaching zone of each respective wing in a closing position.

11. The drive unit according to claim 1, wherein said wings (124,126) are telescopically superposed to each other;

a first of said wings (124,126) being connected with the rack (12,14) that engages with said shaft (20) of said motor (10), and a transmission unit (100) which transmits the motion to a second of said wings (124,126).

12. The drive unit (100) according to claim 11, which comprises:

a serrated gear (110) idly mounted on said shaft (20,120) fixed on one of said wings (124,126);

a first rack (112) fixed to a fixed structure (122) of the elevator car, and a second rack (114) fixed on the other of said wings (124,126);

said racks (112,114) being so arranged as to strike the idly mounted serrated gear (110) on opposite sides of the serrated gear (110).

13. The drive unit according to claim 11, wherein said racks (112,114) are circle-arch curved with a radius corresponding to a circumference concentric with a circular profile of the elevator car and are provided with complementary indentation (112', 114') that engage with that of the gear (110).

14. The drive unit according to claim 1, wherein the racks (12,14) are circle-arch curved according to a radius corresponding to a circumference concentric with a circular profile of the elevator car.

15. The drive unit according to claim 1, wherein said pulley (22) is serrated and strikes a corresponding indentation (12'14') formed on sides, facing and opposite to each other, of said racks (12,14).

16. The drive unit according to claim 1, wherein said motor (10) is supported by a plate (16) provided with guide and sliding means (28,30) for said racks (12,14).

17. The drive unit according to claim 1, wherein said wings (24,26,24',26') are respectively connected to said racks (12,14) by means of arms (36,38).

* * * * *